United States Patent [19]

Kawamura et al.

[11] Patent Number: 4,531,488

[45] Date of Patent: Jul. 30, 1985

[54] FUEL INJECTION PUMP FOR AN INTERNAL COMBUSTION ENGINE

[75] Inventors: Yoshihisa Kawamura, Yokosuka; Toshiaki Tanaka, Chigasaki, both of Japan

[73] Assignee: Nissan Motor Co., Ltd., Japan

[21] Appl. No.: 495,661

[22] Filed: May 18, 1983

[30] Foreign Application Priority Data

Jun. 4, 1982 [JP] Japan ..... 57-82249[U]

[51] Int. Cl.[3] ..... F02B 3/00

[52] U.S. Cl. ..... 123/300; 123/357; 123/502; 417/462

[58] Field of Search ..... 123/299, 300, 502, 501, 123/450, 449, 357, 496; 417/462, 426

[56] References Cited

U.S. PATENT DOCUMENTS 4,173,959 11/1979 Sosnowski et al. ..... 417/462
4,224,903 9/1980 Mowbray ..... 123/506
4,265,200 5/1981 Wessel et al. ..... 123/501
4,367,714 1/1983 DiDomenico et al. ..... 123/449

FOREIGN PATENT DOCUMENTS 3010729 10/1981 Fed. Rep. of Germany ..... 123/450
1218026 1/1971 United Kingdom ..... 123/502
2033959 5/1980 United Kingdom ..... 123/450

*Primary Examiner*—Magdalen Y. C. Moy
*Attorney, Agent, or Firm*—Lowe, King, Price & Becker

[57] ABSTRACT

Fuel is periodically injected into an engine combustion chamber by a first injection device as an engine crankshaft rotates. A timing control device serves to adjust the timing of fuel injection effected by the first injection device with respect to the rotational angle of the crankshaft. Fuel is also periodically injected into the combustion chamber by a second injection device as the crankshaft rotates. Adjustment of the timing of fuel injection effected by the first injection device results in variation of the total fuel injection rate characteristic curve with respect to the rotational angle of the crankshaft.

14 Claims, 9 Drawing Figures

FUEL INJECTION PUMP FOR AN INTERNAL COMBUSTION ENGINE

BACKGROUND OF THE INVENTION

This invention relates to a fuel injection pump for an internal combustion engine, such as a diesel engine.

Diesel engines are supplied with fuel by means of fuel injection pumps, which pressurize fuel periodically with respect to rotation of the engine crankshaft to effect fuel injection into the engine combustion chambers at a desired timing. As soon as fuel is injected into the combustion chambers, the fuel encounters highly compressed and heated air so that it burns spontaneously. Thus, the time of the initiation of fuel injection is an essential parameter determining fuel combustion characteristics. The variation of the rate of fuel injection with the rotational angle of the crankshaft during each fuel injection stroke also affects fuel combustion characteristics.

Especially for vehicular engines, desired characteristic curves or patterns of the fuel injection rate versus crank angles depend on the operating conditions of the engine, such as engine load. At lower loads, the fuel injection curve should be platykurtic and skewed toward high crank angles (as shown in FIG. 1) so that the fuel injection quantity, and thus combustion chamber temperature and pressure, build up gradually. This minimizes synthesis of harmful nitrogen oxide (NOx) exhaust. On the other hand, in order to ensure adequate power output, the fuel injection curve at higher loads should be leptokurtic (as shown in FIG. 2) to induce intense combustion. This also minimizes synthesis of undesirable hydrocarbon (HC) exhaust, smoke, and particulates.

SUMMARY OF THE INVENTION

It is an object of this invention to provide a fuel injection pump for an internal combustion engine which can adjust the profile of the fuel injection rate versus crank angle.

In accordance with this invention, a fuel injection pump is applied to an internal combustion engine having a rotatable crankshaft and a combustion chamber. The fuel injection pump includes a first injection device for injecting fuel into the combustion chamber periodically as the crankshaft rotates. The fuel injection pump also includes a second injection device for injecting fuel into the combustion chamber periodically as the crankshaft rotates. An injection timing control device is provided to adjust the timing of fuel injection effected by the first injection device with respect to the rotational angle of the crankshaft. Adjustment of the timing of fuel injection effected by the first injection device enables adjustment of the total fuel injection rate characteristic curve with respect to the rotational angle of the crankshaft.

The above and other objects, features and advantages of this invention will be apparent from the following description of preferred embodiments thereof, taken in conjunction with the drawings.

DESCRIPTION OF THE PREFERRED EMBODIMENTS

Figure 3:
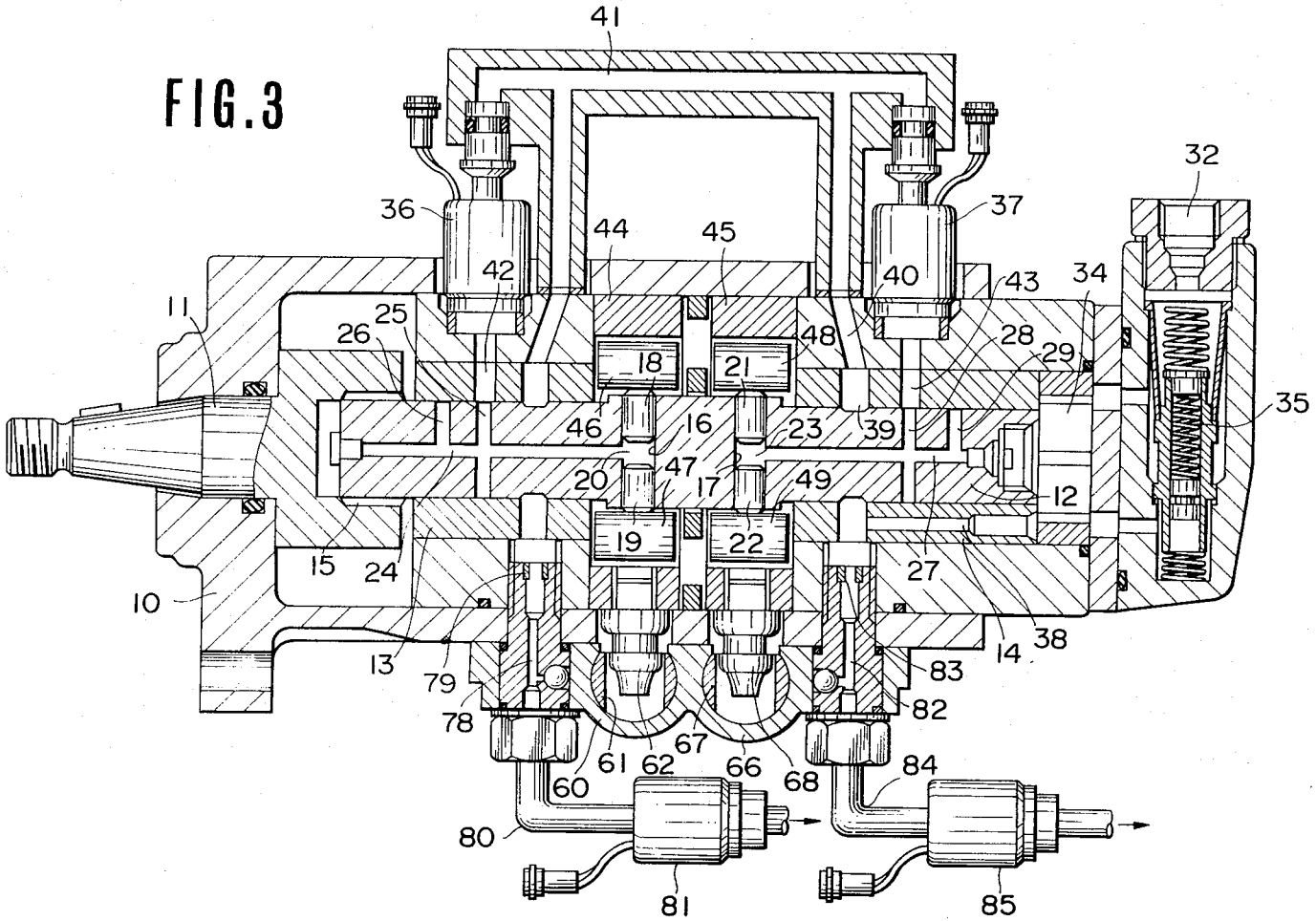
FIG. 3 is a sectional view of a fuel injection pump according to a first embodiment of this invention.
Figure 4:
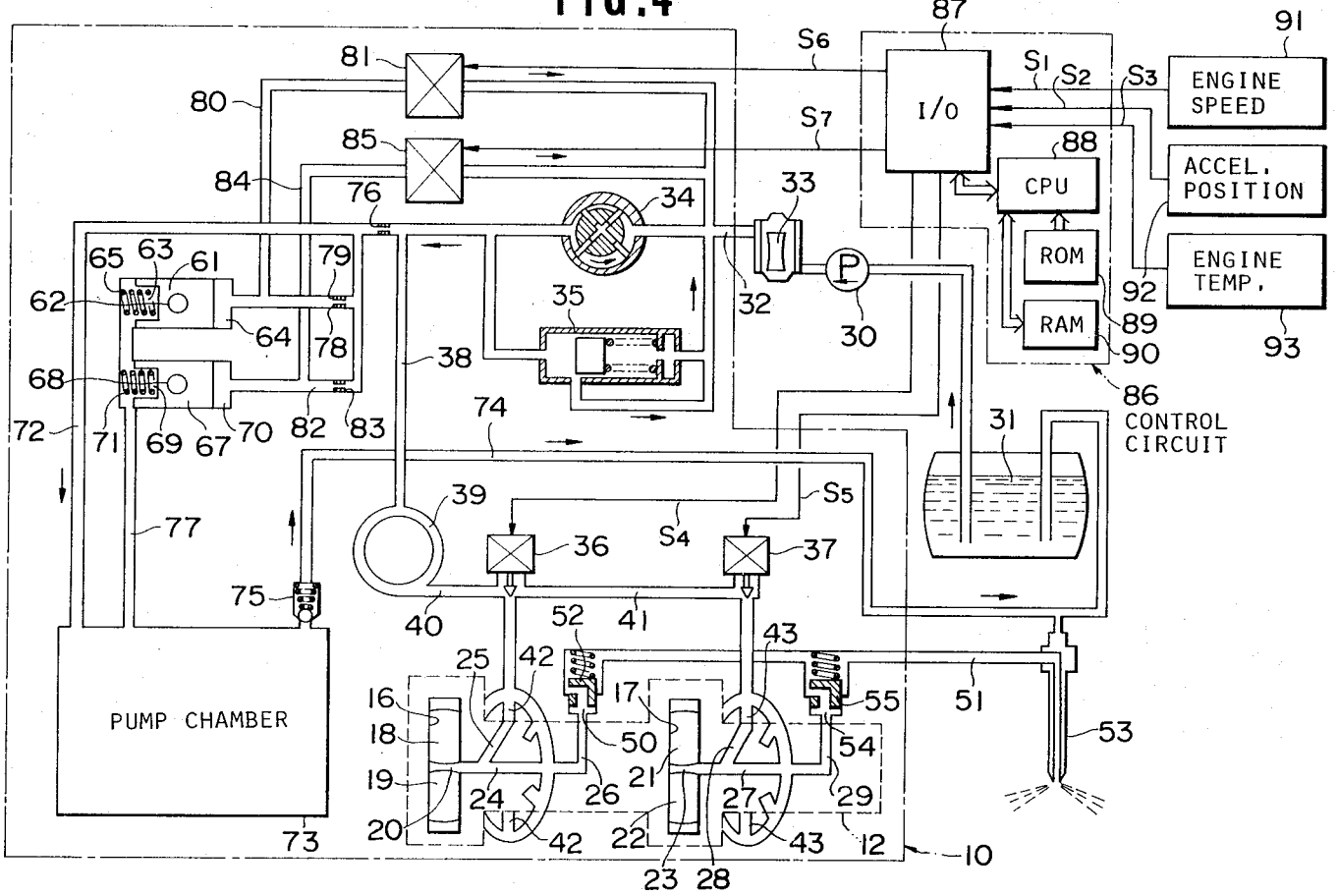
FIG. 4 is a diagram of the fuel injection pump of FIG. 3 and associated peripheral devices.

With reference to FIGS. 3 and 4 showing a first embodiment of this invention, a distribution-type fuel injection pump has a housing 10 and a drive shaft 11. The drive shaft 11 rotatably extends into the housing 10. The drive shaft 11 is connected to the crankshaft of an engine by means of a suitable coupling designed such that the drive shaft 11 will rotate at half the speed of rotation of the crankshaft.

An internal shaft or rotor 12 rotatably extends through axially-spaced first and second cylindrical sleeves 13 and 14 fixedly attached to the housing 10. The rotor 12 is coaxially connected to the drive shaft 11 by means of a spline coupling 15, so that the rotor 12 will rotate together with the drive shaft 11. The rotor 12 has first and second diametrical bores 16 and 17 opposite the central gap between the cylindrical sleeves 13 and 14. A first pair of plungers 18 and 19 are slidably disposed in the first bore 16, so that the plungers 18 and 19 can move radially with respect to the rotor 12. The plungers 18 and 19 are spaced from each other, so that a first working chamber 20 is defined between the plungers 18 and 19. Similarly, a second pair of plungers 21 and 22 are slidably disposed in the second bore 17, and a second working chamber 23 is defined between the plungers 21 and 22.

The rotor 12 has a first blind axial passage 24, one end of which opens into the first working chamber 20 and the other end of which is closed. The rotor 12 has a first diametrical intake passage 25 and a first radial discharge passage 26. The intake passage 25 intersects the axial passage 24, so that the passages 24 and 25 communicate with each other. Both ends of the intake passage 25 open onto the peripheral surface of the rotor 12. The inner end of the discharge passage 26 opens into the axial passage 24. The outer end of the discharge passage 26 opens onto the peripheral surface of the rotor 12.

The rotor 12 has a second blind axial passage 27, one end of which opens into the second working chamber 23 and the other end of which is closed. The rotor 12 has a second diametrical intake passage 28 and a second radial discharge passage 29. The intake passage 28 intersects the axial passage 27, so that the passages 27 and 28 communicate with each other. The ends of the intake passage 28 open onto the peripheral surface of the rotor 12. The inner end of the discharge passage 29 opens into the axial passage 27. The outer end of the discharge passage 29 opens onto the peripheral surface of the rotor 12.

The arrangement of the bore 16, the working chamber 20, and the passages 24, 25, and 26 is mirror-symmetrical to that of the bore 17, the working chamber 23, and the passages 27, 28, and 29 with respect to the plane perpendicularly bisecting the rotor 12.

A feed pump 30 draws fuel from a fuel tank 31 and delivers the fuel to an inlet 32 provided in the housing 10. A fuel filter 33 removes dirt from the fuel forced out of the feed pump 30 toward the inlet 32. A transfer pump 34 located within the housing 10 draws fuel via the inlet 32, which leads to the inlet of the transfer pump 34. The transfer pump 34 is mechanically connected to the rotor 12 so that the engine drives the transfer pump 34 via the drive shaft 11 and the rotor 12. A pressure control valve 35 is connected across the transfer pump 34 to control the fuel pressure across the transfer pump 34. The combination of the transfer pump 34 and the control valve 35 is designed such that the fuel pressure across the transfer pump 34 varies as a predetermined function of the rotational speed of the engine.

The transfer pump 34 forces the fuel toward first and second fuel flow rate control valves 36 and 37 via fuel passages 38, 39, 40, and 41 formed in the walls of the housing 10. One end of the most downstream passage 41 leads to the transfer pump 34 via the passaages 38, 39, and 40. The other end of the passage 41 has two branches communicating with the first and second flow rate control valves 36 and 37, respectively.

A first set of fuel intake ports 42 formed in the walls of the first sleeve 13 and the housing 10 extend radially with respect to the sleeve 13. The intake ports 42 are spaced at fixed angular intervals. The outer ends of the intake ports 42 lead to the first flow rate control valve 36, so that the intake ports 42 can communicate with the passage 41 via the valve 36. The inner ends of the intake ports 42 opening onto the inner surface of the sleeve 13 are located such that as the rotor 12 rotates, the end of the intake passage 25 moves into and out of alignment sequentially with each of the inner ends of the intake ports 42. Thus, the fuel can be conducted from the first flow rate control valve 36 to the first working chamber 20 via any one of the intake ports 42, the intake passage 25, and the axial passage 24. The number of the intake ports 42 equals that of the combustion chambers of the engine.

Likewise, a second set of fuel intake ports 43 formed in the walls of the second sleeve 14 and the housing 10 extend radially with respect to the sleeve 14. The outer ends of the intake ports 43 lead to the second flow rate control valve 37, so that the intake ports 43 can communicate with the passage 41 via the valve 37. The inner ends of the intake ports 43 opening onto the inner surface of the sleeve 14 are located such that as the rotor 12 rotates, the end of the intake passage 28 moves into and out of alignment sequentially with each of the inner ends of the intake ports 43. Thus, fuel can be conducted from the second flow rate control valve 37 to the second working chamber 23 via any one of the intake ports 43, the intake passage 28, and the axial passage 27.

The flow rate control valves 36 and 37 are of the solenoid or electrically-driven type. As the first valve 36 is electrically energized and de-energized, the first valve 36 establishes and blocks the communication between the passage 41 and the intake ports 42, respectively. In the case where the first valve 36 is driven by a pulse signal with a high frequency, the rate of fuel flow through the first valve 36, therefore, depends on the duty cycle of the pulse signal.

Likewise, as the second valve 37 is electrically energized and de-energized, the second valve 37 establishes and blocks the communication between the passage 41 and the intake ports 43, respectively. In the case where the second valve 37 is driven by a pulse signal with a high frequency, the rate of fuel flow through the second valve 37 depends on the duty cycle of the pulse signal.

Between the sleeves 13 and 14, axially-spaced first and second cam rings 44 and 45 disposed within the housing 10 concentrically encircle the rotor 12 and oppose the first and second bores 16 and 17 respectively. The inside diameter of the first ring 44 is sufficiently greater than the outside diameter of the rotor 12 to allow a first pair of rollers 46 and 47, oriented parallel to the rotor 12, to be disposed between the ring 44 and the rotor 12. The outer ends of the plungers 18 and 19 protrude from the rotor 12 and engage the rollers 46 and 47 respectively in such a manner as to allow rotation of the rollers 46 and 47 about the axes of the rollers 46 and 47. The inner surface of the first ring 44 has circumferentially-spaced cam protrusions. The rollers 46 and 47 engage this cam surface of the first ring 44. As the rotor 12 rotates, the rollers 46 and 47 rotate about the axis of the rotor 12 in conformity with rotation of the rotor 12 while rotating also about the axes of the rollers 46 and 47 and maintaining the engagements with the inner surface of the ring 44 and the plungers 18 and 19. As the rollers 46 and 47 ascend the cam protrusions, the rollers 46 and 47 move radially inward and force the plungers 18 and 19 in the same direction, thereby contracting the first working chamber 20. As the rollers 46 and 47 descend the cam protrusions, the rollers 46 and 47 move radially outward and enable the plungers 18 and 19 to move in the same direction, thereby expanding the first working chamber 20. The number of the cam protrusions equals that of the combustion chambers of the engine.

Likewise, the inside diameter of the second ring 45 is sufficiently greater than the outside diameter of the rotor 12 to allow a second pair of rollers 48 and 49, oriented parallel to the rotor 12, to be disposed between the ring 45 and the rotor 12. The outer ends of the plungers 21 and 22 protrude from the rotor 12 and engage the rollers 48 and 49 respectively in such a manner as to allow rotation of the rollers 48 and 49 about the axes of the rollers 48 and 49. The inner surface of the second ring 45 has cam protrusions similar to those formed on the first ring 44. The rollers 48 and 49 engage this cam surface of the second ring 45. As the rotor 12 rotates, the rollers 48 and 49 rotate about the axis of the rotor 12 in conformity with rotation of the rotor 12 while rotating also about the axes of the rollers 48 and 49 and maintaining the engagements with the inner surface of the ring 45 and the plungers 21 and 22. The engagement between the rollers 48 and 49, and the cam ring 45, and the engagement between the rollers 48 and 49, and the plungers 21 and 22 cause and enable contraction and expansion of the second working chamber 23 in a manner similar to the contraction and expansion of the first working chamber 20.

A first set of fuel delivery ports 50 formed in the walls of the first sleeve 13 and the housing 10 extend radially with respect to the sleeve 13. The delivery ports 50 are spaced at fixed angular intervals. The number of the delivery ports 50 equals that of the combustion chambers of the engine. Only one of the delivery ports 50 is shown in FIG. 4. The inner ends of the delivery ports 50 opening onto the inner surface of the sleeve 13 are located such that as the rotor 12 rotates, the outer end of the first discharge passage 26 moves into and out of alignment sequentially with each of the inner ends of the delivery ports 50. Thus, the fuel can be conducted from the first working chamber 20 to any one of the delivery ports 50 via the axial passage 24 and the discharge passage 26. The outer end of each of the delivery ports 50 communicates with a fuel delivery line 51 via a check valve 52. Each of the delivery lines 51 leads to a fuel injection valve or nozzle 53 designed to inject fuel into as associated combustion chamber of the engine. Thus, the fuel can be conducted from the delivery ports 50 to the fuel injection valves 53 via the check valves 52 and the delivery lines 51, respectively. Each of the check valves 52 allows fuel flow only in the direction from the delivery port 50 toward the delivery line 51. The number of the delivery lines 51, the check valves 52, and the fuel injection valves 53 equals that of the combustion chambers of the engine. Only one combination of a delivery line 51, a check valve 52, and a fuel injection valve 53 is shown in FIG. 4.

The angular relationship between the first intake passage 25 and the intake ports 42 is such that the intake passage 25 communicates with one of the intake ports 42 when the first working chamber 20 expands. Thus, the fuel pressurized by the transfer pump 34 enters the intake passage 25 via one of the intake ports 42 and flows toward the first working chamber 20 via the axial passage 24 as the first working chamber 20 expands. In this way, fuel intake stroke is effected. Since the rate of fuel flow through the first valve 36 depends on the duty cycle of the pulse signal driving the first valve 36, the quantity of fuel delivered to the first working chamber 20 during each fuel intake stroke also depends on the duty cycle of the pulse signal.

The angular relationship between the first discharge passage 26 and the delivery ports 50 is such that the discharge passage 26 communicates with one of the delivery ports 50 when the first working chamber 20 contracts. Thus, the fuel is forced out of the first working chamber 20 toward one of the delivery ports 50 via the axial passage 24 and the discharge passage 26 as the first working chamber 20 contracts. The fuel is then transmitted from the delivery port 50 toward the associated fuel injection valve 53 via the check valve 52 and the delivery line 51 before the fuel is injected via the associated fuel injection valve 53 into the combustion chamber of the engine. In this way, fuel injection stroke is effected. Since the quantity of fuel delivered to the first working chamber 20 during each fuel intake stroke depends on the duty cycle of the pulse signal driving the first valve 36, the quantity of fuel forced out of the first working chamber 20 during each fuel injection stroke also depends on the duty cycle of the pulse signal.

A second set of fuel delivery ports 54 formed in the walls of the second sleeve 14 and the housing 10 extend radially with respect to the sleeve 14. The delivery ports 54 are spaced at fixed angular intervals. The number of the delivery ports 54 equals that of the combustion chambers of the engine. Only one of the delivery ports 54 is shown in FIG. 4. The inner ends of the delivery ports 54 opening onto the inner surface of the sleeve 14 are located such that as the rotor 12 rotates, the outer end of the second discharge passage 29 moves into and out of alignment sequentially with each of the inner ends of the delivery ports 54. Thus, the fuel can be conducted from the second working chamber 23 to one of the delivery ports 54 via the axial passage 27 and the discharge passage 29. The outer ends of the delivery ports 54 communicate with the fuel delivery lines 51 via associated check valves 55. Thus, the fuel can be conducted from each delivery port 54 to the associated fuel injection valve 53 via a check valve 55 and a delivery line 51. The check valves 55 allow fuel flow only in the direction from the delivery port 54 toward the delivery line 51. The number of the check valves 55 equals that of the combustion chambers of the engine. Only one of the check valves 55 is shown in FIG. 4.

The angular relationship between the second intake passage 28 and the intake ports 43 is such that the intake passage 28 communicates with one of the intake ports 43 when the second working chamber 23 expands. Thus, the fuel pressurized by the transfer pump 34 enters the intake passage 28 via one of the intake ports 43 and flows toward the second working chamber 23 as the latter expands. In this way, fuel intake stroke is effected.

The angular relationship between the second discharge passage 29 and the delivery ports 54 is such that the discharge passage 29 communicates with one of the delivery ports 54 when the second working chamber 23 contracts. Thus, the fuel is forced out of the second working chamber 23 toward one of the delivery ports 54 via the axial passage 27 and the discharge passage 29 as the second working chamber 23 contracts. The fuel is then transmitted from the delivery port 54 toward the associated fuel injection valve 53 via the check valve 55 and the delivery line 51 before the fuel is injected via the associated fuel injection valve 53 into the combustion chamber of the engine. In this way, fuel injection stroke is effected. The quantity of fuel forced out of the second working chamber 23 during each fuel injection stroke depends on the duty cycle of the pulse signal driving the second valve 37.

The fuel from each of the first delivery ports 50 and from each of the second delivery ports 54 enters a common delivery line 51 via the associated check valves 52 and 55 respectively, and is then injected into the combustion chamber of the engine via a common fuel injection nozzle 53. As a result, the profile of the fuel injection rate during the fuel injection stroke is determined by the sum of the fuel injection rate caused by displacement of the first pair of the plungers 18 and 19 and that caused by displacement of the second pair of the plungers 21 and 22. The quantity of fuel injected during each fuel injection stroke by displacement of the first pair of the plungers 18 and 19 can be adjusted by the first fuel flow rate control valve 36, since the first valve 36 determines the amount of fuel delivered to the first working chamber 20. Likewise, the quantity of fuel injected during each fuel injection stroke by displacement of the second pair of the plungers 21 and 22 can be adjusted by the second fuel flow rate control valve 37.

The first cam ring 44 is supported by the housing 10 in such a manner as to be capable of pivoting about its axis relative to the housing 10. A first timer cylinder 60 is fixed to the outer surface of the housing 10. A first timer piston 61 is slidably disposed within the timer cylinder 60. The timer piston 61 is connected to the first ring 44 by means of a first connecting rod 62 extending through the wall of the housing 10. The combination of the timer cylinder 60 and the timer piston 61 is arranged such that movement of the piston 61 causes the ring 44 to pivot. Primary and secondary timer chambers 63 and 64 are formed in the first cylinder 60 opposing the ends of the first piston 61. A spring 65 located in the primary chamber 63 is seated between the cylinder 60 and the piston 61 to urge the piston 61 relative to the cylinder 60. The first piston 61 moves in accordance with the difference in pressure between the timer chambers 63 and 64.

The second cam ring 45 is supported by the housing 10 in a way similar to that of the first ring 44. A second timer cylinder 66 is fixed to the outer surface of the housing 10. A second timer piston 67 is slidably disposed within the timer cylinder 66. The timer piston 67 is connected to the second ring 45 by means of a second connecting rod 68 extending through the wall of the housing 10. The combination of the timer cylinder 66 and the timer piston 67 is arranged such that movement of the piston 67 causes the ring 45 to pivot. Primary and secondary timer chambers 69 and 70 are formed in the second cylinder 66 opposing the ends of the second piston 67. A spring 71 located in the primary chamber 69 is seated between the cylinder 66 and the piston 67 to urge the piston 67 relative to the cylinder 66. The second piston 67 moves in accordance with the difference in pressure between the timer chambers 69 and 70.

One end of a first fuel circulation line 72 formed in the walls of the housing 10 opens into the fuel passage 38 extending from the outlet of the transfer pump 34. The other end of the first circulation line 72 leads to a pump chamber 73 provided within the housing 10. One end of a second fuel circulation line 74 formed in the walls of the housing 10 communicates with the pump chamber 73 via a pressure control valve 75. The other end of the second circulation line 74 leads to the fuel tank 31. Thus, the fuel drawn by the pumps 30 and 34 from the fuel tank 31 returns to the fuel tank 31 via the fuel passage 38, the first circulation line 72, the pump chamber 73, and the second circulation line 74. A restriction 76 is provided in the first circulation line 72 to restrict the rate of fuel flow therethrough. The control valve 75 adjusts the rate of fuel flow therethrough to control the pressure in the pump chamber 73. Many of the moving parts within the housing 10 are located in the pump chamber 73, so that they are lubricated and cooled by the fuel flowing through the pump chamber 73.

The primary timer chamber 63 communicates with the pump chamber 73 via a pressure passage 77 formed through the walls of the first timer cylinder 60 and the housing 10, so that the primary timer chamber 63 is supplied with the pressure in the pump chamber 73. The associated secondary timer chamber 64 is connected to the first circulation line 72 downstream of the restriction 76 via a pressure passage 78 formed in the walls of the first timer cylinder 60 and the housing 10. A restriction 79 is provided in the pressure passage 78 to restrict the rate of fuel flow therethrough. One end of a pressure relief passage 80 formed in the walls of the housing 10 is connected to the pressure passage 78 downstream of the restriction 79. The other end of the relief passage 80 leads to the inlet of the transfer pump 34. A first fuel injection timing control valve 81 is provided along the relief passage 80 to controllably block and open the relief passage 80. The first valve 81 is of the solenoid or electrically-driven type. As the first valve 81 is electrically energized and de-energized, the first valve 81 opens and blocks the relief passage 80, respectively. When the relief passage 80 is opened, the fuel having come from the outlet of the transfer pump 34 to the passage 78 returns to the inlet of the transfer pump 34 via the relief passage 80 so that the pressure in the secondary timer chamber 64 decreases due to the pressure drops across the restrictions 76 and 79. When the relief passage 80 is blocked, the fuel return to the inlet of the transfer pump 34 via the relief passage 80 is prevented so that the pressure in the secondary timer chamber 64 increases. In the case where the first valve 81 is driven by a pulse signal with a high frequency, the rate of fuel flow through the first valve 81 depends on the duty cycle of the pulse signal so that the pressure in the secondary timer chamber 64 varies as a function of the duty cycle of the pulse signal. As a result, the difference in pressure between the primary and secondary timer chambers 63 and 64 depends on the duty cycle of the pulse signal driving the first valve 81.

Since the first timer piston 61 moves in accordance with the difference in pressure between the primary and secondary timer chambers 63 and 64 as described previously, the position of the piston 61 depends on the duty cycle of the pulse signal driving the first fuel injection timing control valve 81. As the piston 61 moves in the direction of pivoting the first ring 44 in the sense opposite that rotation of the rotor 12, the point of the engine crankshaft revolution at which the first pair of the rollers 46 and 47 encounters the cam protrusions of the first ring 44 advances so that the timing of fuel injection caused by displacement of the first pair of the plungers 18 and 19 also advances in terms of crank angle. As the piston 61 moves in the opposite direction, the timing of fuel injection caused by displacement of the first pair of the plungers 18 and 19 is retarded in terms of crank angle. Thus, the timing of fuel injection caused by displacement of the plungers 18 and 19 depends on the duty cycle of the control signal driving the first fuel injection timing control valve 81.

The primary timer chamber 69 communicates with the pump chamber 73 via the pressure passage 77, so that the primary timer chamber 69 is supplied with the pressure in the pump chamber 73. The associated secondary timer chamber 70 is connected to the first circulation line 72 downstream of the restriction 76 via a pressure passage 82 formed in the walls of the second timer cylinder 66 and the housing 10. A restriction 83 is provided in the pressure passage 82 to restrict the rate of fuel flow therethrough. One end of a pressure relief passage 84 formed in the walls of the housing 10 is connected to the pressure passage 82 downstream of the restriction 83. The other end of the relief passage 84 leads to the inlet of the transfer pump 34. A second fuel injection timing control valve 85 is provided along the relief passage 84 to controllably block and open the relief passage 84. The second valve 85 is of the solenoid or electrically-driven type similar to the first valve 81. The combination of the secondary timer chamber 70, the pressure passage 82, the restriction 83, the relief passage 84, and the second valve 85 is designed in a manner similar to that of the secondary timer chamber 64, the pressure passage 78, the restriction 79, the relief passage 80, and the first valve 81. Therefore, in the case where the second valve 85 is driven by a pulse signal with a high frequency, the pressure in the secondary timer chamber 70 varies as a function of the duty cycle of the control signal. The difference in pressure between the primary and secondary timer chambers 69 and 70 depends on the duty cycle of the pulse signal driving the second valve 85.

Since the second timer piston 67 moves in accordance with the difference in pressure between the timer chambers 69 and 70 as described previously, the position of the piston 67 depends on the duty cycle of the pulse signal driving the second fuel injection timing control valve 85. As the piston 67 moves in the direction of pivoting the second ring 45 in the sense opposite that of rotation of the rotor 12, the point of the engine crankshaft revolution at which the second pair of the rollers 48 and 49 encounters the cam protrusions of the second ring 45 advances so that the timing of fuel injection caused by displacement of the second pair of the plungers 21 and 22 also advances in terms of crank angle. As the piston 67 moves in the reverse direction, the timing of fuel injection caused by displacement of the second pair of the plungers 21 and 22 is retarded in terms of crank angle. Thus, the timing of fuel injection caused by displacement of the plungers 21 and 22 depends on the duty cycle of the pulse signal driving the second fuel injection timing control valve 85.

As shown in FIG. 4, a control circuit 86 includes an input/output (I/O) section 87, a central processing unit (CPU) 88, a read-only memory (ROM) 89, and a random-access memory (RAM) 90. The central processing unit 88 is electrically connected to the I/O section 87, and the memories 89 and 90 to constitute a microprocessor unit in conjunction therewith. An engine speed sensor 91 is associated with the crankshaft or camshaft of the engine to detect the rotational speed of the engine. The speed sensor 91 generates a signal $S_1$ representative of the rotational speed of the engine. The output terminal of the speed sensor 91 is electrically connected to the I/O section 87 to transmit the engine speed signal $S_1$ to the control circuit 86. An accelerator pedal position sensor 92 is associated with an accelerator pedal (not shown) to detect the position or the depression angle of the accelerator pedal which indicates the power required of the engine. The position sensor 92 generates a signal $S_2$ representative of the position of the accelerator pedal. The output terminal of the position sensor 92 is electrically connected to the I/O section 87 to transmit the accelerator position signal $S_2$ to the control circuit 86. An engine coolant temperature sensor 93 is attached to the engine to detect the temperature of the engine coolant. The temperature sensor 93 generates a signal $S_3$ representative of the engine coolant temperature. The output terminal of the temperature sensor 93 is electrically connected to the I/O section 87 to transmit the coolant temperature signal $S_3$ to the control circuit 86. The control circuit 86 generates pulse signals $S_4$, $S_5$, $S_6$, and $S_7$ in response to the signals $S_1$, $S_2$, and $S_3$ representing the engine operating conditions as described above. The pulse signals $S_4$, $S_5$, $S_6$, and $S_7$ are outputted via the I/O section 87. The I/O section 87 is electrically connected to the control valves 36, 37, 81, and 85 to transmit the pulse signals $S_4$, $S_5$, $S_6$, and $S_7$ to the control valves 36, 37, 81, and 85, respectively, in order to controllably drive the control valves 36, 37, 81, and 85. Specifically, the control circuit 86 controls the duty cycles of the respective pulse signals $S_4$, $S_5$, $S_6$, and $S_7$ in response to the engine operating condition signals $S_1$, $S_2$, and $S_3$ to adjust the control valves 36, 37, 81, and 85 in accordance with the engine operating conditions. Adjustments of the respective control valves 36, 37, 81, and 85 result in changes in the profile of the fuel injection rate during each fuel injection stroke versus crank angle.

The control circuit 86 operates in accordance with a program stored in the memory 89. First, the control circuit 86 reads the engine rotational speed and the accelerator pedal position derived from the signals $S_1$ and $S_2$ respectively. Second, the control circuit 86 determines basic desired values of the respective duty cycles of the pulse signals $S_4$, $S_5$, $S_6$, and $S_7$ on the basis of the engine rotational speed and the accelerator pedal position. To this end, the memory 89 holds four tables in which four sets of the basic desired values of the duty cycles of the pulse signals $S_4$, $S_5$, $S_6$, and $S_7$ are respectively plotted as functions of the engine rotational speed and the accelerator pedal position. The determination of the basic desired values is achieved by using these tables in a well-known table look-up. Third, the control circuit 86 reads the engine coolant temperature derived from the signal $S_3$. Fourth, the control circuit 86 corrects the basic desired values on the basis of the engine coolant temperature. This correction is executed by means of a preset equation. In this way, the control circuit 86 determines the final desired values of the respective duty cycles of the pulse signals $S_4$, $S_5$, $S_6$, and $S_7$. Fifth, the control circuit 86 produces the pulse signals $S_4$, $S_5$, $S_6$, and $S_7$ whose respective duty cycles are equal to the above final desired values. The control circuit 86 periodically repeats the above sequence of actions. As a result, the control circuit 86 controls the duty cycles of the respective pulse signals $S_4$, $S_5$, $S_6$, and $S_7$ in accordance with the engine rotational speed, the accelerator pedal position, and the engine coolant temperature.

The control of the timing of fuel injection effected by displacement of the first pair of the plungers 18 and 19 is independent of that of the timing of fuel injection effected by displacement of the second pair of the plungers 21 and 22, since the fuel injection timing control valves 81 and 85 are driven by the independent signals $S_6$ and $S_7$ respectively. Furthermore, the control of the quantity of fuel injected during each fuel injection stroke effected by displacement of the first pair of the plungers 18 and 19 is independent of that of the second pair of the plungers 21 and 22, since the flow rate control valves 36 and 37 are driven by the independent signals $S_4$ and $S_5$ respectively. This independent relationship between the two fuel injection systems enables adjustment of the profile of the fuel injection rate versus crank angle. Specifically, the basic desired values of the respective duty cycles of the pulse signals $S_4$, $S_5$, $S_6$, and $S_7$, and the temperature-correction equation are chosen so as to realize the optimal profile of the fuel injection rate curve in accordance with the engine operating conditions.

Figure 1:
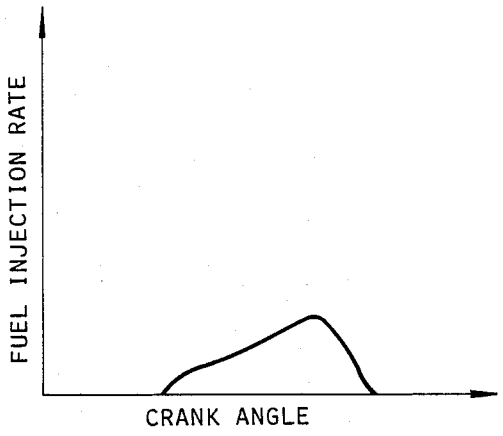
FIG. 1 is a diagram showing a desired fuel injection rate characteristic curve at low engine loads.
Figure 5:
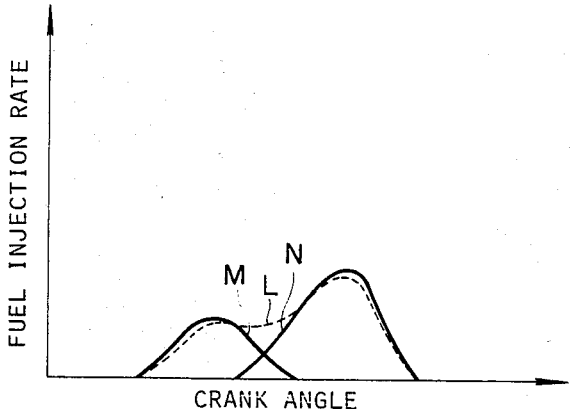
FIG. 5 is a diagram showing a fuel injection rate characteristic curve attained by the fuel injection pump of FIGS. 3 and 4.

When the engine speed signal $S_1$ and the accelerator pedal position signal $S_2$ indicates low engine loads, the timing of fuel injection effected by the first injection system is advanced relative to the timing of fuel injection effected by the second injection system in terms of crank angle. As shown by FIG. 5 in which the letters M and N denote the fuel injection rate curves of the first and second injection systems respectively, the quantity of fuel injected by the first injection system is smaller than that of fuel injected by the second injection system under low engine load conditions. As shown by the letter L in FIG. 5 denoting the resultant or total fuel injection rate curve, the resultant or total quantity of fuel injected builds up gradually in a way similar to that shown in FIG. 1. These fuel injection characteristics under the low engine load conditions minimize synthesis of harmful nitrogen oxide (NOx) exhaust.

Figure 2:
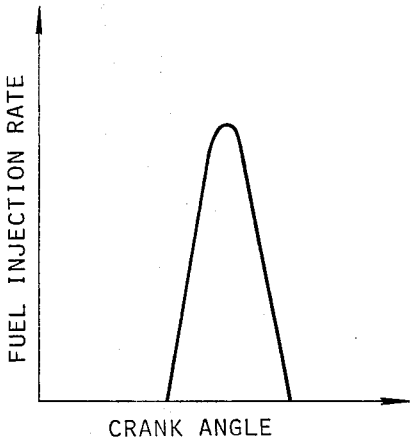
FIG. 2 is a diagram showing a desired fuel injection rate characteristic curve at high engine loads.

When the engine speed signal $S_1$ and the accelerator pedal position signal $S_2$ indicate great engine loads, the timing of fuel injection effected by the first injection system is coincident with that of fuel injection effected by the second injection system. This results in leptokurtic resultant or total fuel injection rate curves similar to that shown in FIG. 2, which ensure sufficiently high engine power and also minimize synthesis of undesirable hydrocarbon (HC) exhaust, smoke, and particulates.

Figure 6:
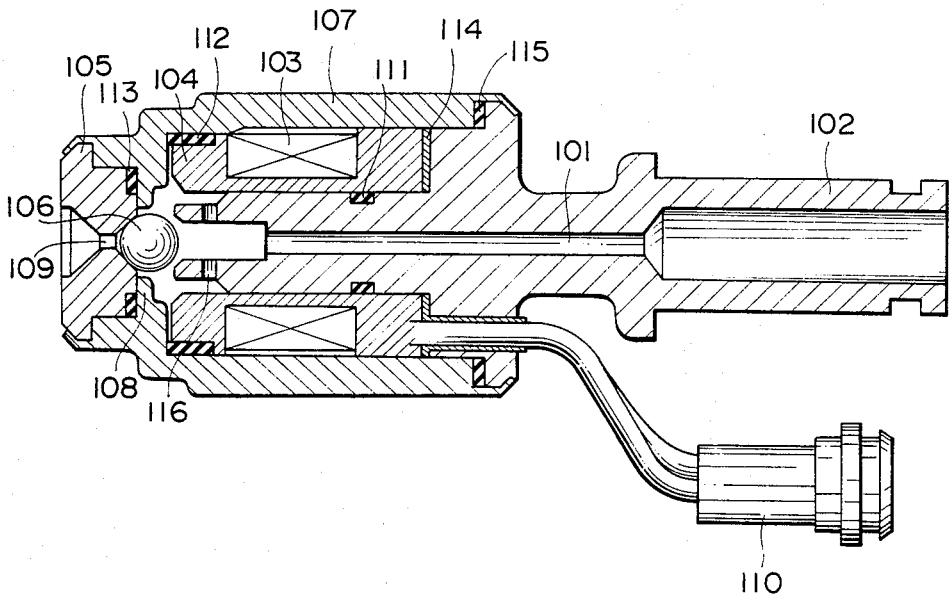
FIG. 6 is a sectional view of one of the electrically-driven control valves of FIG. 4.

FIG. 6 shows the details of the control valves 36, 37, 81, and 85. A bore 101 extends axially through a main magnetic cylinder 102. A control coil or winding 103 is wound on a bobbin 104 fitted onto one end of the cylinder 102. A valve seat member 105 opposes the end face of the cylinder 102 with a spacing formed therebetween, which accommodates a spherical valve member 106 made of magnetic field responsive material. A casing 107 houses the cylinder 102, the bobbin 104, and the seat member 105. The casing 107 has an inwardly-extending side magnetic member 108 designed to influence movement of the valve member 106. A nozzle hole 109 extends through the center of the seat member 105. The nozzle hole 109 is blocked and opened by the valve member 106. The winding 103 is electrically connected to the control circuit 86 (see FIG. 4) via a connector 110 and leads to receive appropriate one of the pulse signals $S_4$, $S_5$, $S_6$, and $S_7$. An O-ring 111 is provided between the cylinder 102 and the bobbin 104. An O-ring 112 is provided between the bobbin 104 and the casing 107. An O-ring 113 is provided between the seat member 105 and the casing 107. A shim 114 is provided between the bobbin 104 and the cylinder 102. A shim 115 is provided between the cylinder 102 and the casing 107. A bypass passage 116 diametrically extending through the cylinder 102 connects the bore 101 with the spacing between the seat member 105 and the end face of the cylinder 102.

When an electrical current flows through the winding 103, the main and side magnetic members 102 and 108 are magnetized, thereby urging the valve member 106 away from the seat member 105 until the valve member 106 comes into contact with the end face of the magnetic member 102. In this case, fluid can flow through the bore 101, the bypass passage 116, the spacing between the cylinder 102 and the seat member 105, and the nozzle hole 109.

When the electrical current is interrupted, the main and side magnetic members 102 and 108 are demagnetized. Therefore, the valve member 106 is urged away from the magnetic member 102 until the valve member 106 comes into contact with the seat member 105, provided that the pressure in the bore 101 is higher than the pressure in the nozzle hole 109. In this case, the valve member 106 blocks the nozzle orifice 109, and thus prevents fluid flow through the bore 101, the bypass passage 116, the spacing, and the nozzle hole 109.

While the pulse signal $S_4$, $S_5$, $S_6$, or $S_7$ is at a high level, electrical current flows through the winding 103. While the pulse signal $S_4$, $S_5$, $S_6$, or $S_7$ is at a low level, electrical current is interrupted.

In the case of the first fuel flow rate control valve 36, the bore 101 communicates with the fuel passage 41 (see FIGS. 3 and 4) and the nozzle orifice 109 communicates with the intake ports 42 (see FIGS. 3 and 4). In the case of the second fuel flow rate control valve 37, the bore 101 communicates with the fuel passage 41 (see FIGS. 3 and 4) and the nozzle orifice 109 communicates with the intake ports 43 (see FIGS. 3 and 4). In the case of the first fuel injection timing control valve 81, the bore 101 communicates with the secondary timer chamber 64 (see FIG. 4) and the nozzle orifice 109 communicates with the inlet of the transfer pump 34. In the case of the second fuel injection timing control valve 85, the bore communicates with the secondary time chamber 70 and the nozzle orifice 109 communicates with the inlet of the transfer pump 34.

Figure 7:
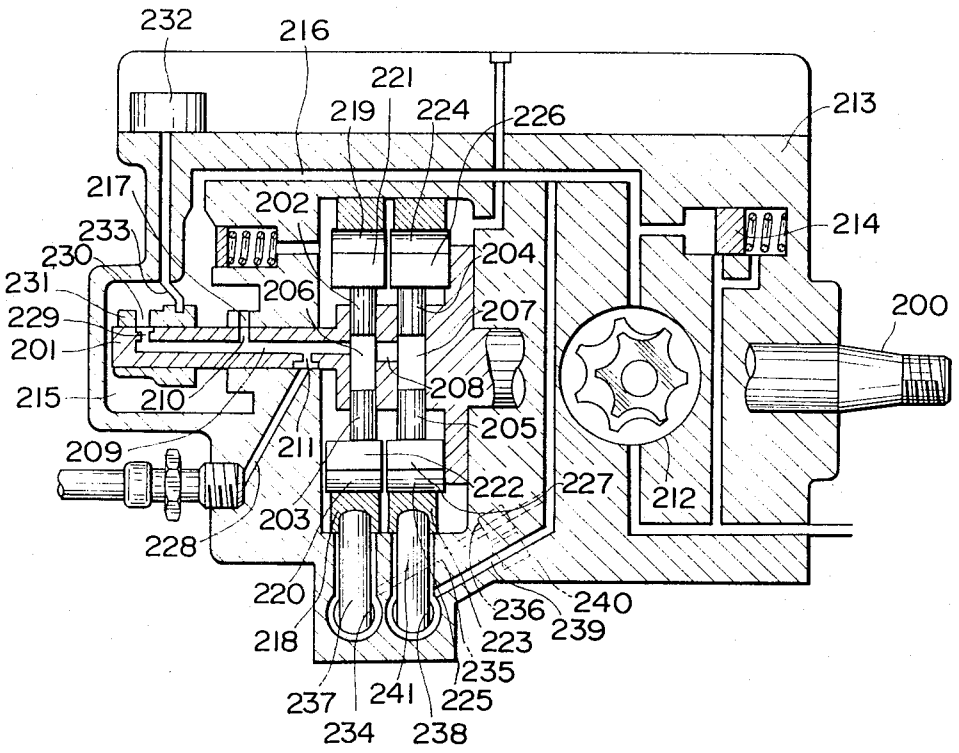
FIG. 7 is a sectional view of a fuel injection pump according to a second embodiment of this invention.

FIG. 7 shows a second embodiment of this invention adapted to a fuel injection pump similar to that disclosed in the manual of AMERICAN BOSCH MODEL 75.

A drive shaft 200 coupled to the crankshaft of an engine is provided to rotate a shaft or rotor 201 as the crankshaft rotates. A first pair of radially extending plungers 202 and 203 are slidably fitted into the rotor 201. The plungers 202 and 203 can slide radially with respect to the rotor 201. Similarly, a second pair of plungers 204 and 205 are fitted into the rotor 201, so as to be radially slidable. A first working chamber 206 is defined between the first pair of the plungers 202 and 203. A second working chamber 207 is defined between the second pair of the plungers 204 and 205. The working chambers 206 and 207 communicate with each other via an axial communication passage 208 formed in the rotor 201. One end of another axial passage 209 formed in the rotor 201 opens into the first working chamber 206. The inner ends of a set of radial intake passages 210 formed in the rotor 201 open into the axial passage 209. The outer ends of the intake passages 210 open onto the periphery of the rotor 201. The inner end of a radial discharge passage 211 formed in the rotor 201 opens into the axial passage 209. The outer end of the discharge passage 211 opens onto the periphery of the rotor 201.

Fuel is drawn from a fuel tank (not shown) by a feed pump (not shown), and is then drawn by a transfer pump 212 within a housing 213. A pressure control valve 214 is connected across the transfer pump 212 to control the pressure across the transfer pump 212. The outlet of the transfer pump 212 leads to a pump chamber 215 via a fuel passage 216, so that the fuel forced out of the transfer pump 212 enters the pump chamber 215 via the fuel passage 216.

The pump chamber 215 is defined within the housing 213. The rotor 201 extends through walls of the housing 213, which also define a fuel intake port 217 extending radially with respect to the rotor 201. The outer end of the intake port 217 opens into the pump chamber 215. The inner end of the intake port 217 opposes the periphery of the rotor 201. Each of the intake passages 210 sequentially communicates with the intake port 217 as the rotor 201 rotates. Thus, the fuel can flow from the pump chamber 215 toward the working chambers 206 and 207 via the intake port 217, the intake passage 210, the axial passages 209 and 208 when the intake passage 210 communicates with the intake port 217.

A first cam ring 218 coaxially surrounds the rotor 201. A first pair of rollers 219 and 220 are provided between the ring 218 and the rotor 201. The rollers 219 and 220 are retained by holders 221 and 222 mounted on the outer ends of the plungers 202 and 203, respectively. As the rotor 201 rotates, the rollers 219 and 220 rotate about the axis of the rotor 201 while rotating also about the axes of the rollers 219 and 220. The rollers 219 and 220 engage the inner surface of the ring 218 formed with cam protrusions. As the rollers 219 and 220 ascend the cam protrusions due to rotation of the rotor 201, the plungers 202 and 203 move radially inwards, thereby contracting the first working chamber 206.

A second cam ring 223 coaxially surrounds the rotor 201. A second pair of rollers 224 and 225 are provided between the ring 223 and the rotor 201. The rollers 224 and 225 are retained by holders 226 and 227 mounted on the outer ends of the plungers 204 and 205, respectively. As the rotor 201 rotates, the rollers 224 and 225 rotate about the axis of the rotor 201 while rotating also about the axes of the rollers 224 and 225. The rollers 224 and 225 engage the inner surface of the ring 223 formed with cam protrusions. As the rollers 224 and 225 ascend the cam protrusions due to rotation of the rotor 201, the plungers 204 and 205 move radially inwards, thereby contracting the second working chamber 207.

The walls of the housing 13 define a set of fuel delivery ports 228 extending radially with respect to the rotor 201 and spaced angularly. The inner ends of the delivery ports 228 oppose the periphery of the rotor 201. The discharge passage 211 sequentially communicates with each of the delivery ports 228 as the rotor 201 rotates. Each of the outer ends of the delivery ports 228 leads to an associated fuel injection nozzle or valve (not shown). As the working chambers 206 and 207 contract, the fuel is forced out of the working chambers 206 and 207 toward the fuel injection nozzle via the axial passages 208 and 209, the discharge passage 211, and the delivery port 228 so that fuel injection is effected. The resultant rate of fuel injection consists of two components, one due to the displacement of the first pair of the plungers 202 and 203 and the other due to that of the second pair of the plungers 204 and 205.

The rotor 201 has a radial cut-off port 229, the inner end of which leads to the axial passage 209 and the outer end of which opens onto the periphery of the rotor 201 within the pump chamber 215. As the rotor 201 rotates, the cut-off passage 229 periodically communicates with the pump chamber 215 via a second cut-off port 230 formed radially through a control sleeve 231 slidably mounted on the rotor 201. When the cut-off port 229 communicates with the pump chamber 215, the fuel forced out of the working chambers 206 and 207 by displacement of the plungers 202, 203, 204, and 205 returns to the pump chamber 215 via the axial passages 208 and 209, and the cut-off ports 229 and 230 so that fuel injection is ended.

The relationship between the cut-off ports 229 and 230 follows a conventional technique in which axial movement of the control sleeve 231 relative to the rotor 201 adjusts the timing of the end of each fuel injection stroke in terms of crank angle. Since the fuel injection end timing affects the quantity of fuel injected during each fuel injection stroke, the axial position of the control sleeve 231 relative to the rotor 201 determines the fuel injection quantity.

A pulse-driven or stepper motor 232 is mechanically connected to the control sleeve 231 by a suitable coupling 233 to control the axial position of the control sleeve 231. The motor 232 receives a pulse signal generated by a control circuit (not shown), which controllably drives the motor 232 via the pulse signal to control the fuel injection quantity.

A first timer piston 234 is slideably fitted into the walls of the housing 213. Primary and secondary chambers are formed at the opposite ends of the timer piston 234 respectively, the primary chamber communicating with the inlet of the transfer pump 212 and the secondary chamber communicating with the outlet of the transfer pump 212 via a passage 235 formed in the walls of the housing 213. The time piston 234 moves in accordance with the difference in pressure between the primary and secondary chambers. A first electrically-driven or solenoid fuel injection timing control valve 236 controllably blocks and opens the passage 235. The first valve 236 receives a pulse signal generated by the control circuit, which controllably drives the first valve 236 via the pulse signal to control the pressure in the secondary chamber in a manner similar to that of the first embodiment. Control of the pressure in the secondary chamber results in control of the position of the timer piston 234. The timer piston 234 is connected via a connecting rod 237 to the first cam ring 218, which can pivot about the axis of the rotor 201. As the timer piston 234 moves, the cam ring 218 pivots. This shifting of the cam ring 218 causes an adjustment of the timing of fuel injection effected by displacement of the first pair of the plungers 202 and 203 in a manner similar to that of the first embodiment. Therefore, control of the first valve 236 results in control of the timing of fuel injection effected by the plungers 202 and 203.

A second timer piston 238 is designed in a manner similar to the first timer piston 234. Primary and secondary chambers are formed at the opposite ends of the timer piston 238, the primary chamber communicating with the inlet of the transfer pump 212 and the secondary chamber communicating with the outlet of the transfer pump 212 via a passage 239 formed in the walls of the housing 213. The timer piston 238 moves in accordance with the difference in pressure between the associated primary and secondary chambers. A second fuel injection timing control valve 240 similar to the first valve 236 controllably blocks and opens the passage 239. The control circuit controllably drives the second valve 240 to control the pressure in the secondary chamber in a manner similar to that of the first embodiment. Control of the pressure in the secondary chamber results in control of the position of the timer piston 238. The timer piston 238 is connected via a connecting rod 241 to the second cam ring 223, which can pivot about the axis of the rotor 201. As the timer piston 238 moves, the cam ring 223 pivots. This shifting of the cam ring 223 causes a variation of the timing of fuel injection effected by displacement of the second pair of the plungers 204 and 205 in a manner similar to that of the first embodiment. Therefore, control of the second valve 240 results in control of the timing of fuel injection effected by the plungers 204 and 205.

Figure 8:
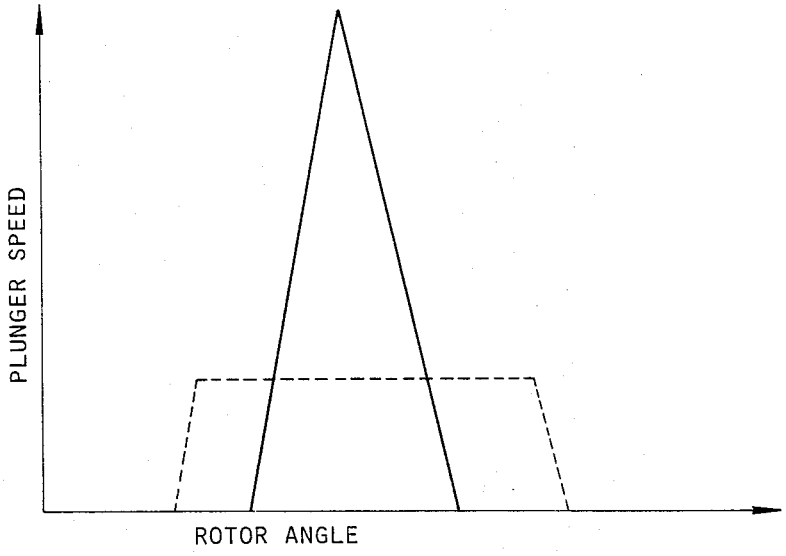
FIG. 8 is a diagram showing relationships between the speeds of the plungers and the rotational angles of the rotor of FIG. 7.

The profile of the cam protrusions on the first cam ring 218 is designed such that the radial speed of the first pair of the plungers 202 and 203 substantially remains at a relatively small value with respect to varying rotational angles of the rotor 201 as shown by the broken lines in FIG. 8. The profile of the cam protrusions on the second cam ring 223 is designed such that the radial speed of the second pair of the plungers 204 and 205 varies as a sharply-peaked isosceles triangle having a relatively large peak value with respect to varying rotational angles of the rotor 201 as shown by the solid lines in FIG. 8. The diameter of the second pair of the plungers 204 and 205 is greater than that of the first pair of the plungers 202 and 203.

Figure 9:
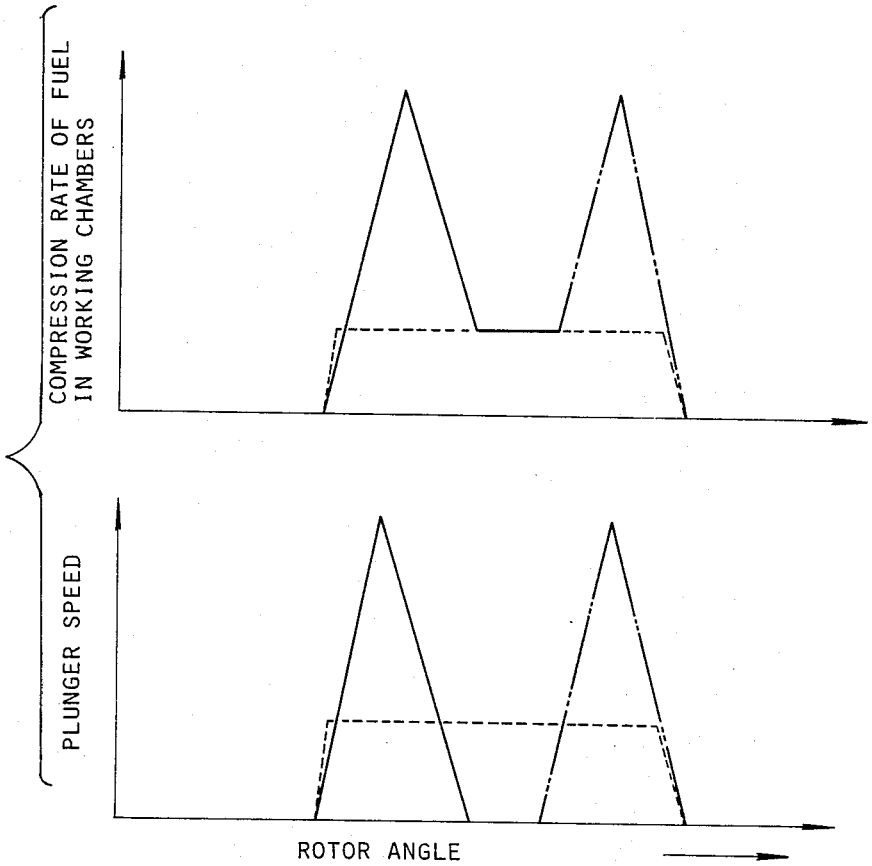
FIG. 9 is a diagram showing relationships between the speeds of the plungers and the rotational angles of the rotor of FIG. 7, and those between the compression rates of fuel in the working chambers and the rotational angles of the rotor of FIG. 7.

Control of the timing of fuel injection effected by the second pair of the plungers 204 and 205 is independent of that of the timing of fuel injection effected by the first pair of the plungers 202 and 203, so that the fuel injection rate characteristic curve can be adjusted. As shown in FIG. 9 where the dashed lines refer to fuel injection effected by the first pair of the plungers 202 and 203 and the solid and the dot-dash lines refer to extremes of fuel injection effected by the second pair of the plungers 204 and 205, the timing of fuel injection effected by the second plunger pair can be coincident with the start of fuel injection effected by the first plunger pair as shown by the solid lines, or with the end of fuel injection effected by the first plunger pair as shown by the dot-dash lines and with any point inbetween. Such variation in the timing of fuel injection effected by the second plunger pair results in change in the profile of the fuel injection rate characteristic curve.

It should be understood that further modifications and variations may be made in this invention without departing from the spirit and scope of this invention as set forth in the appended claims. For example, the control valves 36, 37, 81, and 85 may also be of other types, such as the spool type and the rotary type provided with a reed.

In the case where this invention is applied to an engine in which the combustion chambers each consist of a main and an auxiliary section, a main fuel injection valve or nozzle may be provided for each of the main combustion chambers and an auxiliary fuel injection valve or nozzle may be provided for each of the auxiliary combustion chambers. In this case, the first fuel injection system may be associated with the main fuel injection nozzles to effect fuel injection therethrough and the second fuel injection system may be associated with the auxiliary fuel injection nozzles to effect fuel injection therethrough.

What is claimed is:

1. A fuel injection pump for an internal combustion engine having a rotatable crankshaft and a combustion chamber, the injection pump comprising:

(a) first means for periodically injecting fuel into the combustion chamber as the crankshaft rotates;

(b) second means for adjusting the timing of fuel injection effected by the first means with respect to the rotational angle of the crankshaft;

(c) third means for periodically injecting fuel into the combustion chamber as the crankshaft rotates;

(d) fourth means for adjusting the quantity of fuel injected by the first means during each fuel injection; and (e) fifth means for adjusting the quantity of fuel injected by the third means during each fuel injection, whereby the total fuel injection rate characteristic curve with respect to the rotational angle of the crankshaft can be varied by adjusting the timing of fuel injection effected by the first means.

2. A fuel injection pump as recited in claim 1, further comprising sixth means for adjusting the timing of fuel injection effected by the third means with respect to the rotational angle of the crankshaft.

3. A fuel injection pump as recited in claim 2, further comprising seventh means for sensing an operating condition of the engine and generating a signal indicative thereof, the second and sixth means being responsive to the engine operating condition signal and being operative to adjust the respective fuel injection timings in accordance with the engine operating condition.

4. A fuel injection pump as recited in claim 3, wherein the engine operating condition is the rotational speed of the crankshaft.

5. A fuel injection pump as recited in claim 3, wherein the engine operating condition is the power required of the engine.

6. A fuel injection pump as recited in claim 3, wherein the engine operating condition is the temperature of the engine.

7. A fuel injection pump as recited in claim 2, further comprising seventh means for sensing an operating condition of the engine and generating a signal indicative thereof, the second and sixth means being responsive to the engine operating condition signal and being operative to adjust the fuel injection timings in accordance with the engine operating condition, the fourth and fifth means being responsive to the engine operating condition signal and being operative to adjust the respective fuel injection quantities in accordance with the engine operating condition.

8. A fuel injection pump as recited in claim 7, wherein the engine operating condition is the rotational speed of the crankshaft.

9. A fuel injection pump as recited in claim 7, wherein the engine operating condition is the power required of the engine.

10. A fuel injection pump as recited in claim 7, wherein the engine operating condition is the temperature of the engine.

11. A fuel injection pump for an internal combustion engine having a rotatable crankshaft and a combustion chamber, the injection pump comprising:

(a) a rotor coupled to the crankshaft to rotate in accordance with rotation of the crankshaft, the rotor having first and second working chambers;

(b) first and second plungers slidably mounted on the rotor, displacement of the first plunger causing contraction of the first working chamber, displacement of the second plunger causing contraction of the second working chamber;

(c) means for displacing the first plunger periodically with respect to rotation of the rotor;

(d) means for displacing the second plunger periodically with respect to rotation of the rotor;

(e) means for supplying fuel to the first and second working chambers;

(f) a fuel injection nozzle for injecting fuel into the combustion chamber:

(g) first conducting means for conducting fuel from the first working chamber to the fuel injection nozzle to inject fuel into the combustion chamber via the fuel injection nozzle when the first working chamber contracts;

(h) second conducting means for conducting fuel from the second working chamber to the fuel injection nozzle to inject fuel into the combustion chamber via the fuel injection nozzle when the second working chamber contracts;

(i) means for adjusting the timing of displacement of the first plunger with respect to the rotational angle of the crankshaft;

(j) means for adjusting the timing of displacement of the second plunger with respect to the rotational angle of the crankshaft;

(k) means for adjusting the rate of fuel supply to the first working chamber; and (l) means for adjusting the rate of fuel supply to the second working chamber.

12. A fuel injection pump as recited in claim 1, wherein the first means comprises a first check valve disposed in a first fuel discharge passage leading to the combustion chamber via a common fuel delivery line to conduct fuel to be injected, and wherein the third means comprises a second check valve disposed in a second fuel discharge passage leading to the combustion chamber via the common fuel delivery line to conduct fuel to be injected.

13. A fuel injection pump as recited in claim 12, wherein the first conducting means comprises a first fuel discharge passage for connecting the first working chamber to a common fuel delivery line leading to the fuel injection nozzle and the second conducting means comprises a second fuel discharge passage for connecting the second working chamber to the common fuel delivery line, and further comprising a first check valve disposed in the first fuel discharge passage and a second check valve disposed in the second fuel discharge passage.

14. A fuel injection pump for an internal combustion engine having a rotatable crankshaft and a combustion chamber, the injection pump comprising:

(a) first means for periodically injecting fuel into the combustion chamber as the crankshaft rotates, comprising a first check valve disposed in a first fuel discharge passage leading to the combustion chamber via a common fuel delivery line to conduct fuel to be injected;

(b) second means for periodically injecting fuel into the combustion chamber as the crankshaft rotates, comprising a second check valve disposed in a second fuel discharge passage leading to the combustion chamber via the common fuel delivery line to conduct fuel to be injected;

(c) third means for adjusting the timing of fuel injection effected by the first means relative to the timing of fuel injection effected by the second means;

(d) fourth means for adjusting the quantity of fuel injected by the first means during each fuel injection; and (e) fifth means for adjusting the quantity of fuel injected by the second means during each fuel injection.

* * * * *